US012460359B2

(12) United States Patent
Schut

(10) Patent No.: US 12,460,359 B2
(45) Date of Patent: Nov. 4, 2025

(54) CONCRETE FINISHING TOOL

(71) Applicant: Greg Schut, Sioux Center, IA (US)

(72) Inventor: Greg Schut, Sioux Center, IA (US)

(73) Assignee: Greg Schut, Sioux Center, IA (US)

( * ) Notice: Subject to any disclaimer, the term of this patent is extended or adjusted under 35 U.S.C. 154(b) by 577 days.

(21) Appl. No.: 18/058,086

(22) Filed: Nov. 22, 2022

(65) Prior Publication Data

US 2023/0265619 A1 Aug. 24, 2023

Related U.S. Application Data

(60) Provisional application No. 63/311,496, filed on Feb. 18, 2022.

(51) Int. Cl.
*E01C 19/44* (2006.01)

(52) U.S. Cl.
CPC ..... *E01C 19/44* (2013.01)

(58) Field of Classification Search
CPC ..... E01C 19/484; E01C 19/40; E01C 19/402; E01C 19/35
See application file for complete search history.

(56) References Cited

U.S. PATENT DOCUMENTS 3,526,173 A * 9/1970 Brandstetter ..... E01C 19/4873 404/108
4,507,015 A * 3/1985 Furukawa ..... E01C 13/065 425/456
4,802,788 A * 2/1989 Smith ..... E01C 23/24 404/94
7,686,538 B2 * 3/2010 Lutz ..... E01C 19/402 404/114
8,113,736 B2 * 2/2012 Wilson, Sr. ..... E01C 19/21 404/90
8,596,905 B2 * 12/2013 Stephens ..... E04G 21/10 404/102
8,714,873 B2 * 5/2014 Stephens ..... E01C 19/402 404/102
8,905,674 B2 * 12/2014 Rees ..... E01C 21/00 404/93
9,248,850 B1 * 2/2016 Romas ..... B62B 1/22
9,657,447 B2 * 5/2017 Mattson ..... B05D 1/26
9,957,726 B2 * 5/2018 Milane ..... E04F 21/08
11,885,078 B2 * 1/2024 Ligman ..... E01C 19/40
2007/0292208 A1 * 12/2007 Lutz ..... E01C 19/402 404/114
2011/0097150 A1 * 4/2011 Sinnamon ..... E01C 19/15 404/87
2013/0223929 A1 * 8/2013 Stephens ..... C04B 28/02 404/114
2021/0062437 A1 * 3/2021 Mikowychok ..... E01C 19/402
2022/0307206 A1 * 9/2022 Kappel ..... E01C 19/48

* cited by examiner

*Primary Examiner* — Abigail A Risic
(74) *Attorney, Agent, or Firm* — HOVEY WILLIAMS LLP

(57) ABSTRACT

A concrete finishing tool that more effectively fills and smooths voids on the surface of a slab of wet concrete includes a float; one or more wet concrete holding trays positioned on top of the float; electrically operated cylinders or other actuators for raising the trays to dump the wet concrete onto a concrete slab; and a mechanical vibrator for vibrating the trays to urge concrete from the trays onto the slab.

20 Claims, 11 Drawing Sheets

CONCRETE FINISHING TOOL

RELATED APPLICATIONS

The present application is related to and claims provisional benefit of U.S. Provisional Patent Application No. 63/311,496, filed Feb. 18, 2022, and entitled "CONCRETE FINISHING TOOL", which is hereby incorporated by reference in its entirety herein.

BACKGROUND

Bull floats and other concrete finishing tools are often used to finish concrete shortly after it has been poured and screeded. These concrete finishing tools draw up fine aggregate and cement to the surface of a concrete slab and compact and smooth the surface of the slab.

While finishing concrete in this manner, small voids in the slab surface are often encountered. To fill these voids, wet concrete must be placed in them and then smoothed. This is a relatively easy procedure for sidewalks and other narrow concrete slabs because a mason can easily reach and gently fill the voids. But filling voids in larger slabs such as concrete driveways and basements is much more difficult because the voids can't be easily reached. In these cases, masons often must throw wet cement at the voids. This is imprecise and messy because the thrown concrete often misses the voids and creates additional voids and other disruptions in the surfaces of the slabs that must be leveled and smoothed.

SUMMARY

The present invention solves the above-described problems and provides a distinct advance in the art of concrete finishing tools and methods. More particularly, the present invention provides a concrete finishing tool and method of using the same that more effectively fills and smooths voids on the surface of a slab of wet concrete.

A concrete forming tool constructed in accordance with an embodiment of the invention broadly comprises a float; one or more wet concrete holding trays positioned on top of the float; and electrically operated cylinders or other actuators for raising the trays to dump the wet concrete onto a concrete slab as it is being finished with the forming tool.

The float may any size and shape and has a smooth lower surface for finishing concrete as it is pushed and pulled across a poured concrete slab. In one embodiment, the float is attached to a handle or rod so it can be pushed or pulled by a single user. In other embodiments, the float may be attached to ropes and pulled back and forth by several users.

The trays hold wet cement and are connected to the float by hinges. In one embodiment, two trays are provided, and in another embodiment, only one tray is provided.

Trays are shiftable between lowered and raised positions by the cylinders. The cylinders may be operated in unison so that they raise or lower the trays together or may be operated independently to raise or lower just one tray at a time. The cylinders may also incrementally raise and lower the trays to any position between fully lowered and fully raised positions.

In one embodiment, the cylinders are controlled by one or more switches or dials supported on or near the handle. In another embodiment, the cylinders are controlled by a wireless remote control transceiver in communication with the cylinders.

The forming tool may also include one or more vibration elements attached to or embedded within the float and/or the trays to urge wet cement from the trays and to assist with smoothing the slab. These vibration elements may also be controlled by switches on the handle and/or a remote control. In other embodiments, the vibration elements may turn on automatically when the trays are raised. In some embodiments, the switches on the handle and/or the remote control can adjust the vibrational forces of the vibration elements to select the proper amount of force needed to deposit a desired amount of cement onto the slab.

In use, a mason fills the tray or trays with wet cement or other fillable materials and then manipulates the float over a slab of concrete to smooth the upper surface of the slab. When a void or other imperfection is detected, the mason may operate one or both the cylinders to raise the tray or trays to deposit wet cement from the trays onto a desired location on the slab. The mason may also operate the vibration elements to urge the wet cement from the trays. The mason may then manipulate the float over the newly deposited cement to integrate it with the other cement in the slab.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
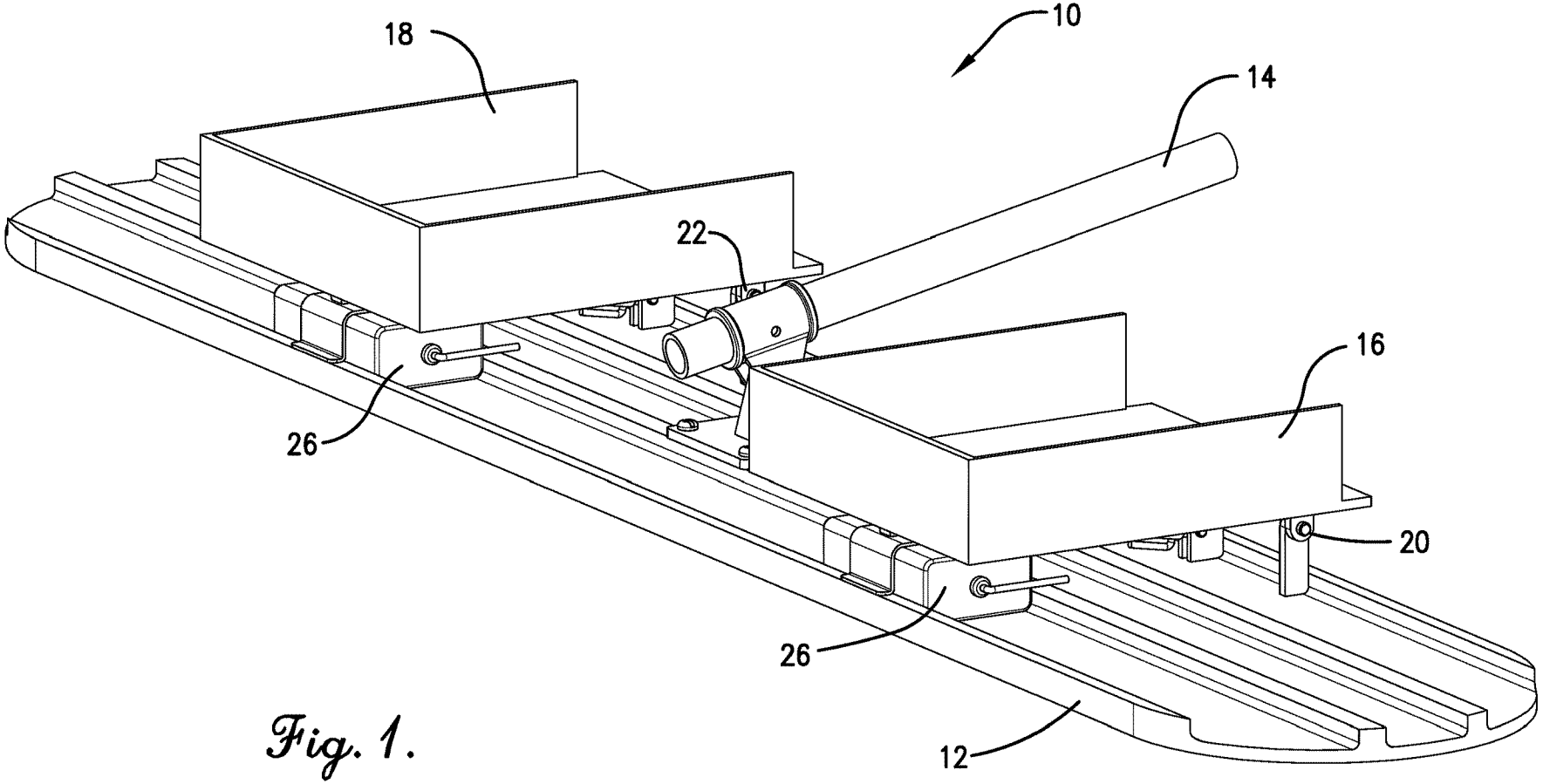
FIG. 1 is a front perspective view of a concrete forming tool constructed in accordance with an embodiment of the invention shown with its concrete holding trays in their lowered positions.
Figure 2:
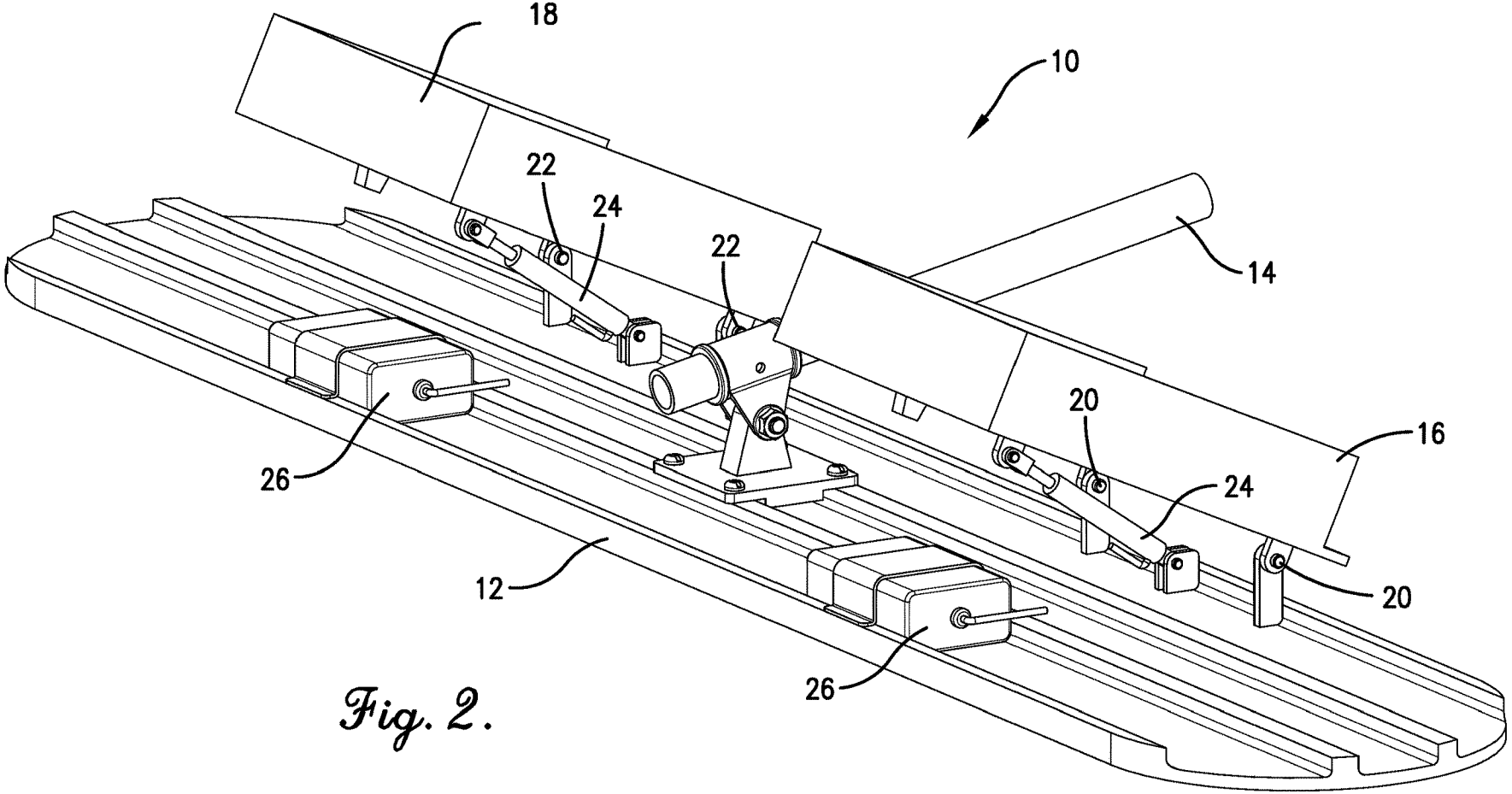
FIG. 2 is a front perspective view of the concrete forming tool shown with its concrete holding trays in their raised positions.
Figure 3:
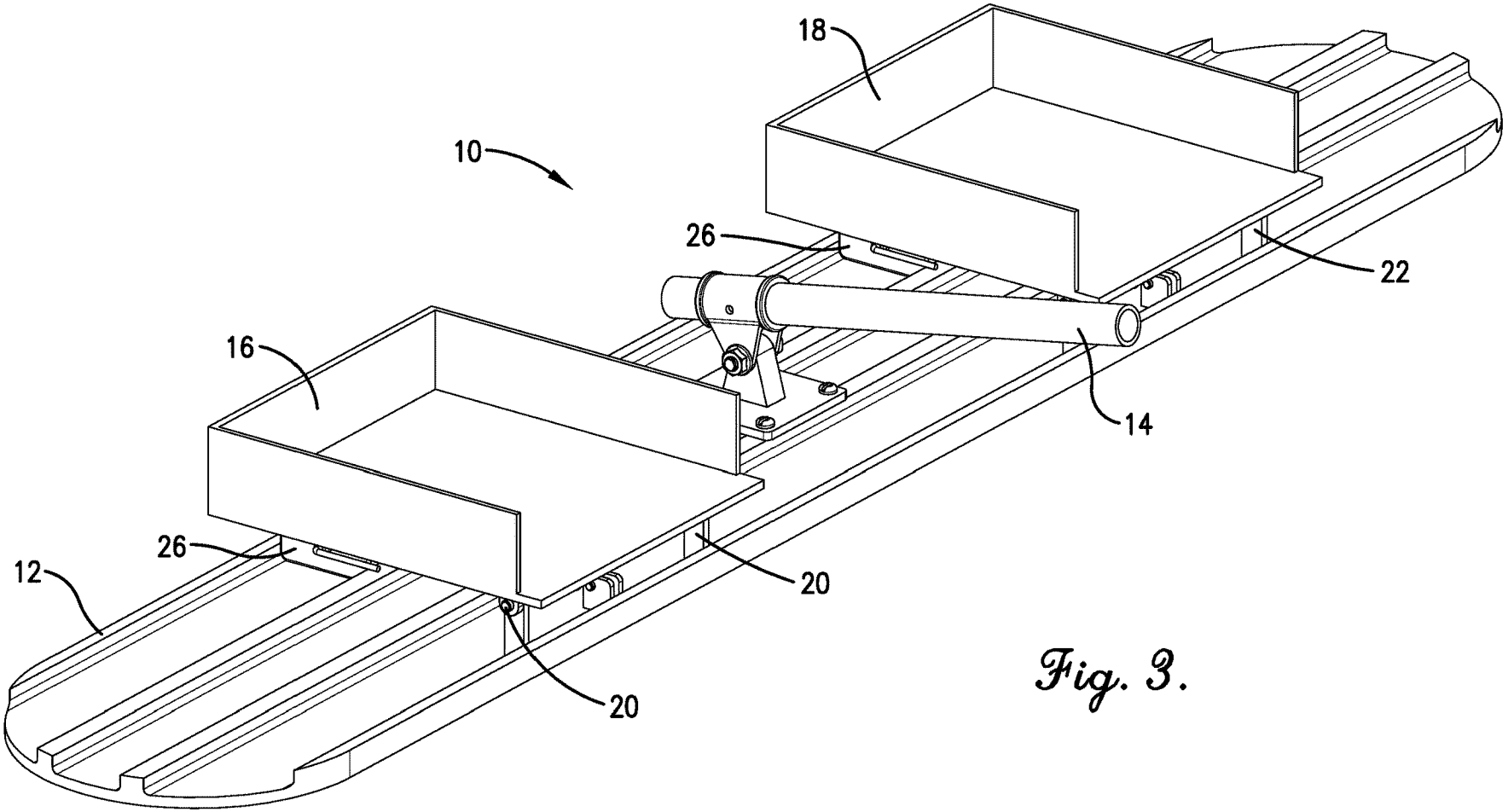
FIG. 3 is a rear perspective view of the concrete forming tool shown with its concrete holding trays in their lowered positions.
Figure 4:
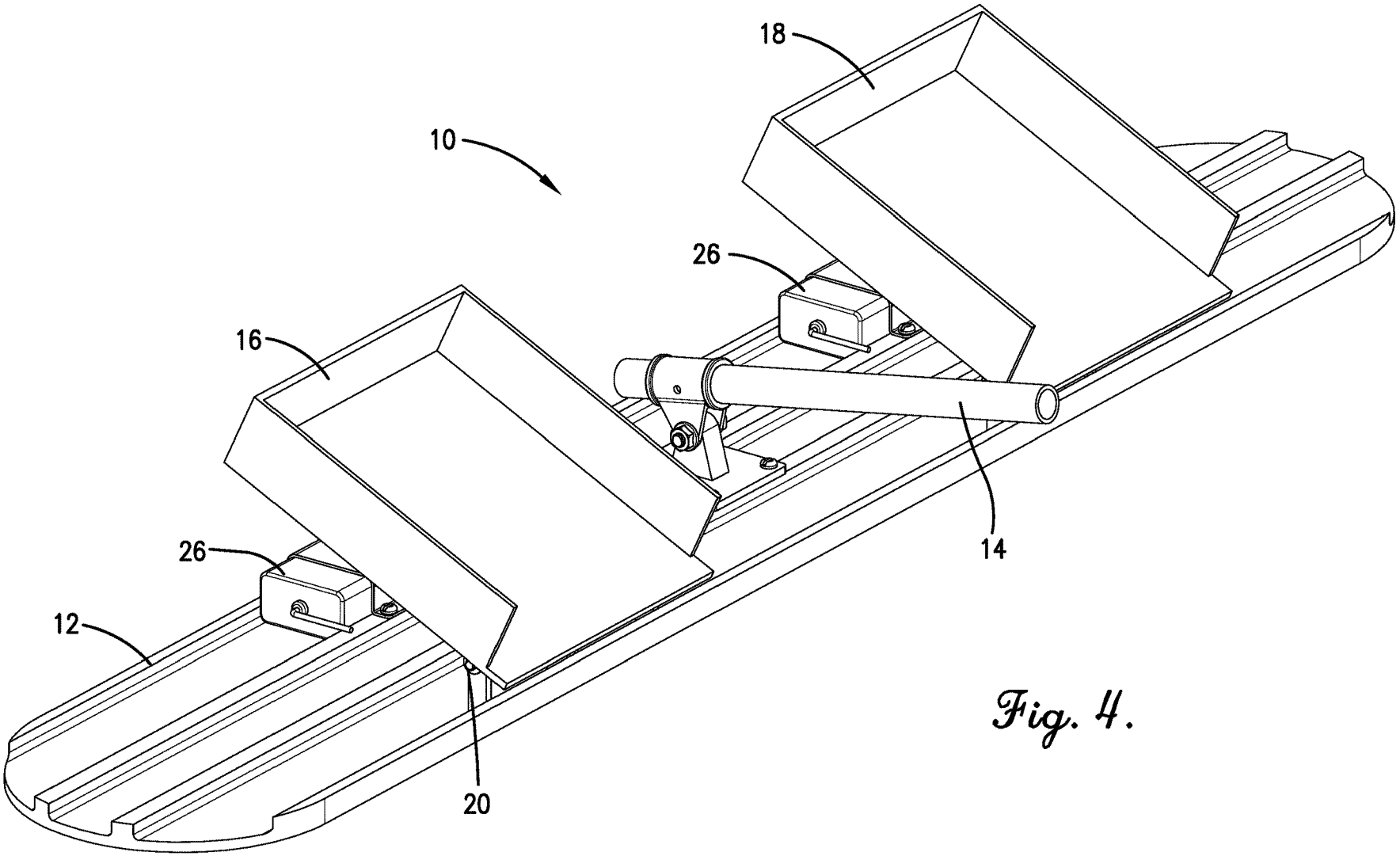
FIG. 4 is a rear perspective view of the concrete forming tool shown with its concrete holding trays in their raised positions.
Figure 5:
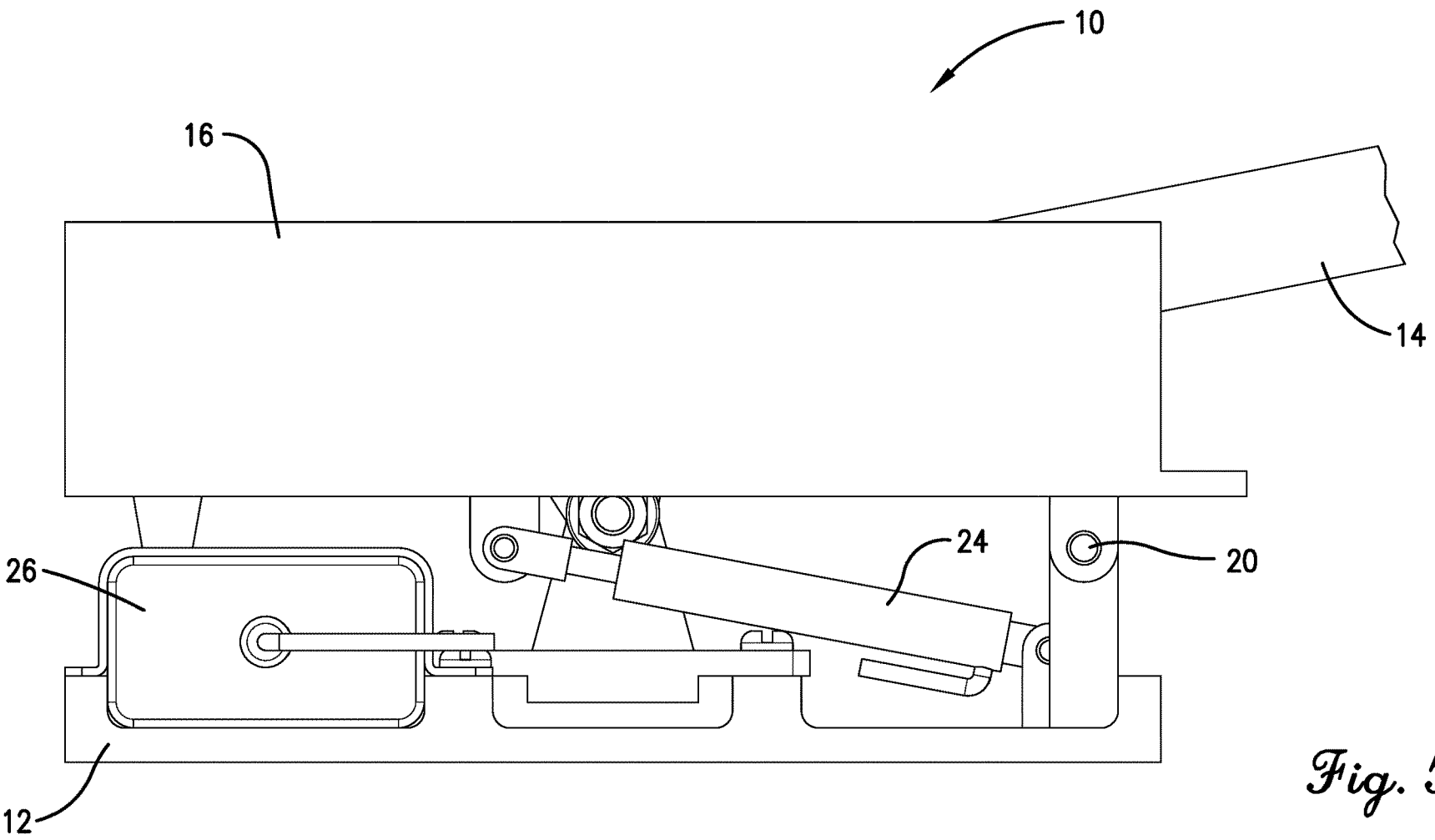
FIG. 5 is a side elevational view of the concrete forming tool shown with its concrete holding trays in their lowered positions.
Figure 6:
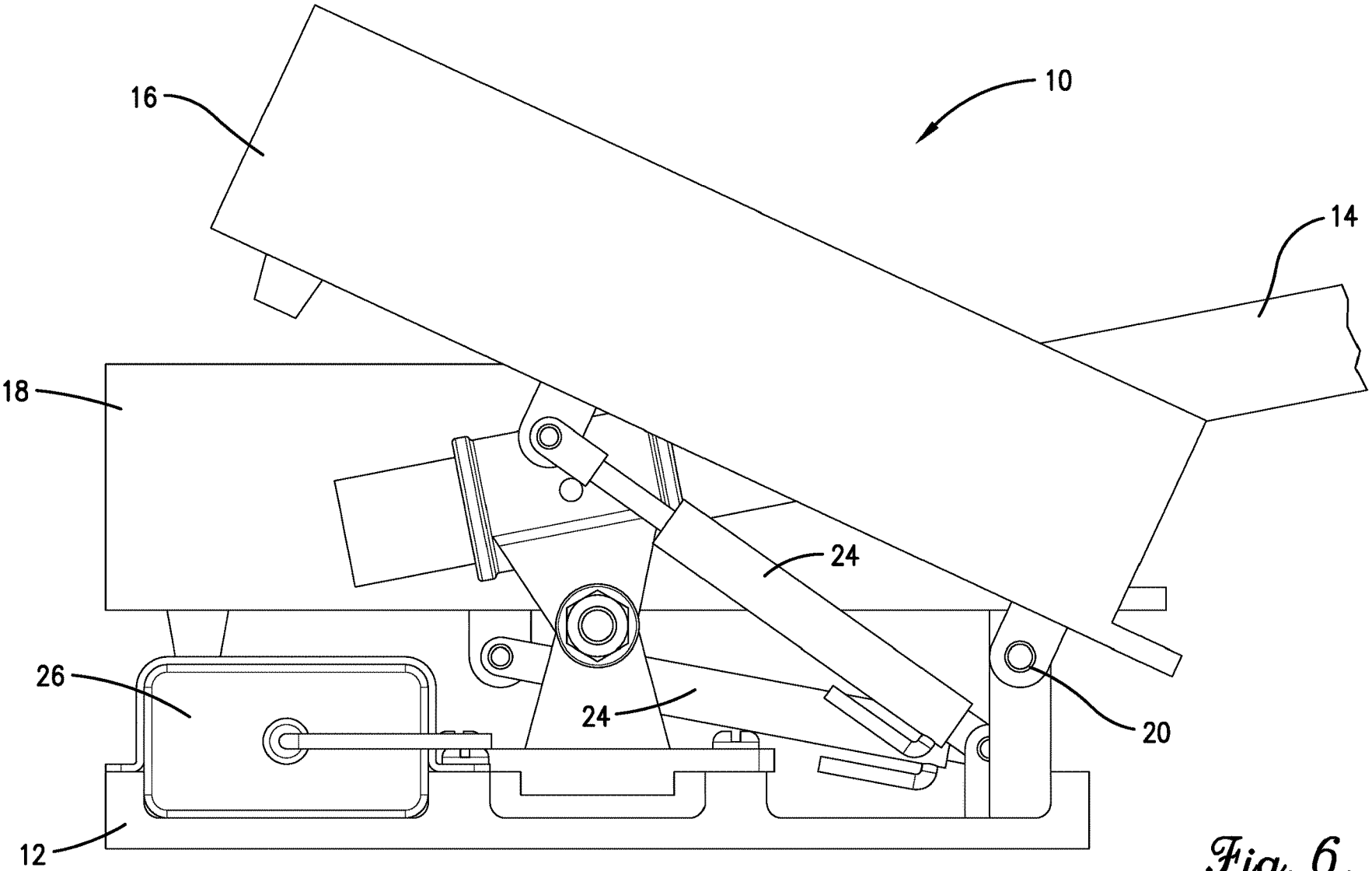
FIG. 6 is a side elevational view of the concrete forming tool shown with its concrete holding trays in their raised positions.

The drawing figures do not limit the present invention to the specific embodiments disclosed and described herein. The drawings are not necessarily to scale, emphasis instead being placed upon clearly illustrating the principles of the invention.

DESCRIPTION OF INVENTION

A concrete forming tool 10 constructed in accordance with an embodiment of the invention is illustrated in the attached drawing figures. The forming tool broadly comprises a float 12; one or more wet concrete holding trays 16, 18 positioned on top of the float; and electrically operated cylinders 24 or other actuators for raising the trays to dump the wet concrete onto a concrete slab as it is being finished with the forming tool.

The float 12 may be formed in any size and of any materials and has a smooth lower surface for finishing a concrete slab as it is pushed and pulled across the slab by the handle 14. In one embodiment, the float is attached to a handle or rod so it can be pushed or pulled by a single user. In other embodiments, the float may be attached to ropes and pulled back and forth by several users.

In one embodiment depicted in FIGS. 1-6, the concrete forming tool 10 has two trays 16, 18. The trays 16, 18 are positioned on top of the float on opposite sides of handle 14 and may be any size to hold any amount of wet cement. The trays each preferably have 3 vertical side walls that define an interior volume for holding wet cement and an open side that faces the rear or front of the float for passing the cement to a slab. The trays are pivotally connected to the float by hinges 20,22.

The actuators 24 are connected between the upper surface of the float and the trays to shift the trays between lowered and raised positions. The actuators may be electronically operated cylinders, linear actuators, rotating actuators, or any other mechanisms that can lift the trays. The actuators 24 may be operated in unison so that they raise or lower together or may be operated independently of one another. The actuators may also incrementally raise the trays to any position between the fully lowered and fully raised positions.

Figure 11:
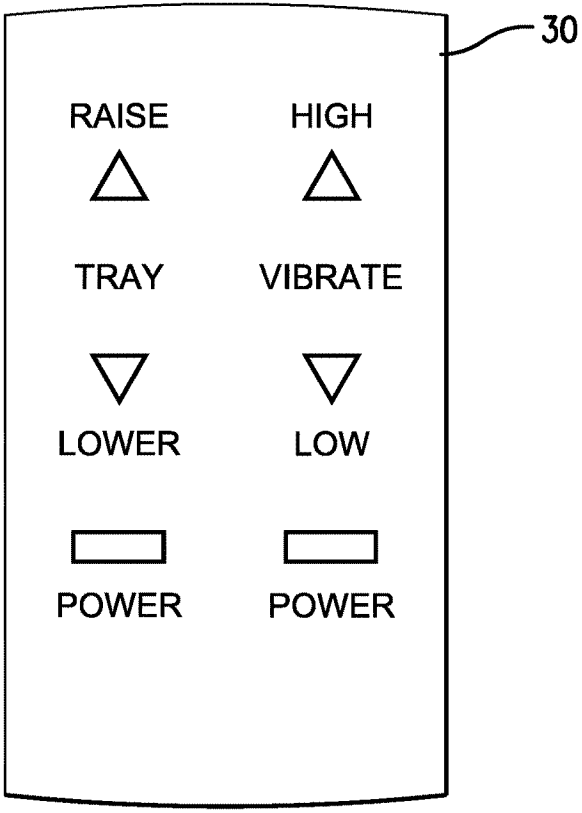
FIG. 11 is a top view of a wireless remote control unit that may be used to remotely control functions of the concrete forming tool.
Figure 10:
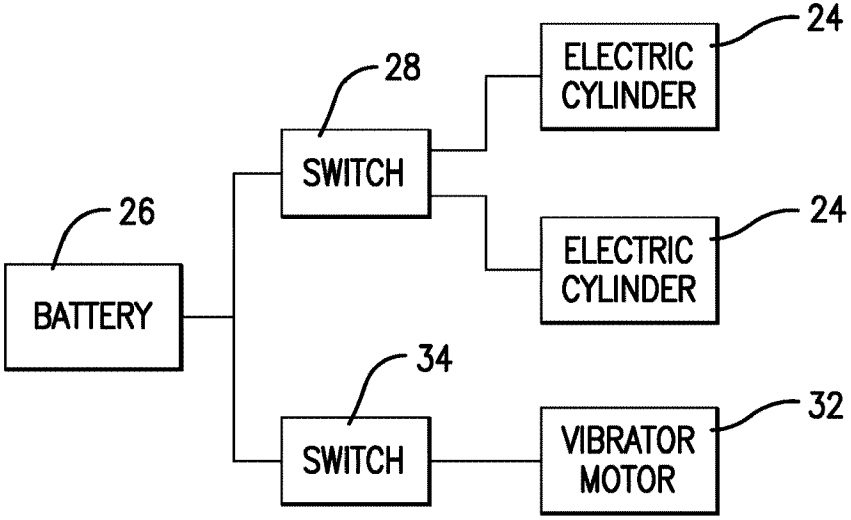
FIG. 10 is a block diagram of control components of the concrete forming tool.

As shown in FIG. 10, the actuators 24 are electrically connected to and powered by a battery 26 or other power source and controlled by one or more switches 28 or dials. In one embodiment, the switches/dials are supported on or near the handle and operated by a mason to raise and lower the trays. In another embodiment illustrated in FIG. 11, the switches are controlled by a wireless remote control transceiver 30.

Figure 7:
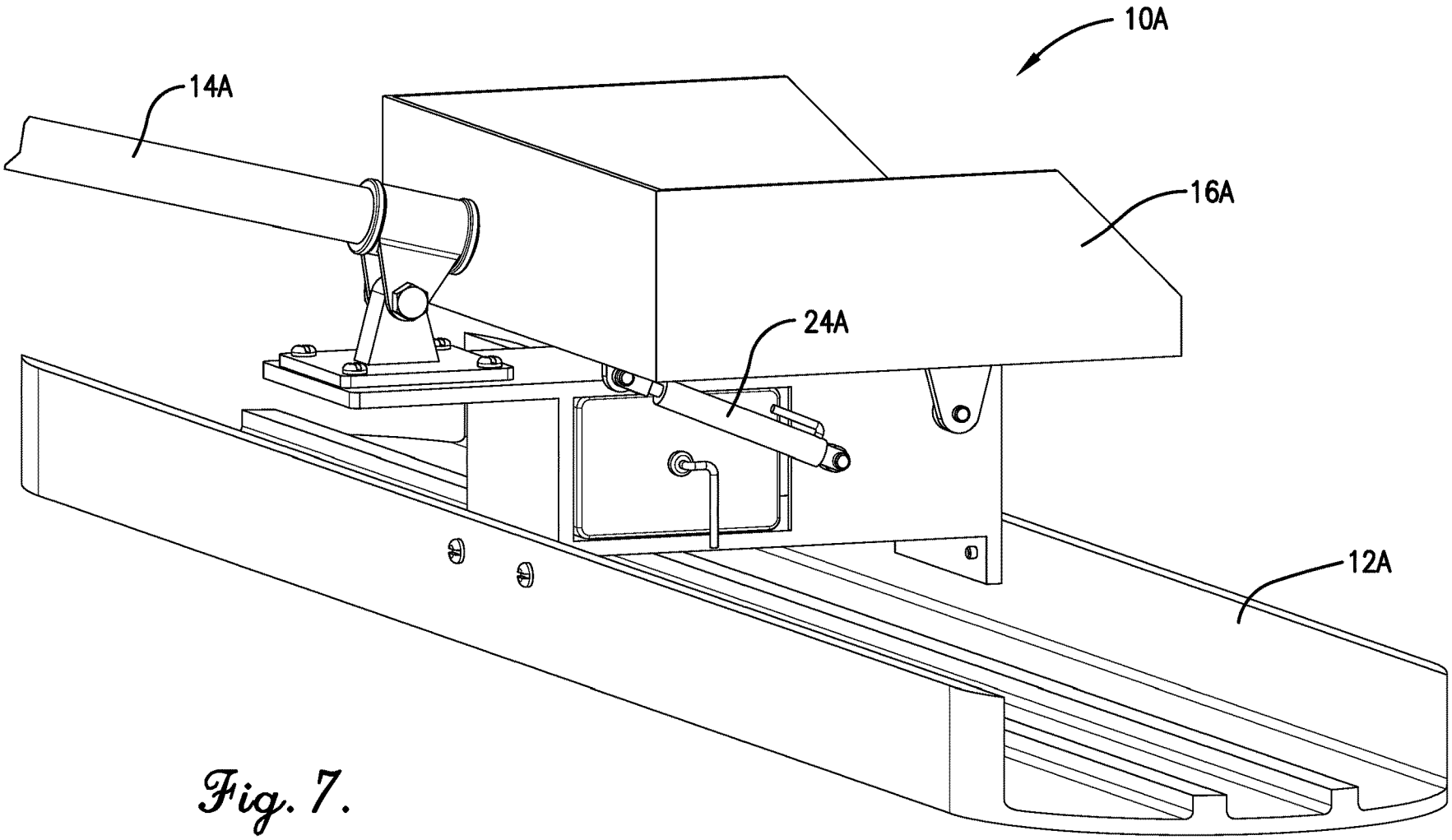
FIG. 7 is a rear perspective view of a concrete forming tool constructed in accordance with another embodiment of the invention showing a single concrete holding tray in a lowered position.
Figure 8:
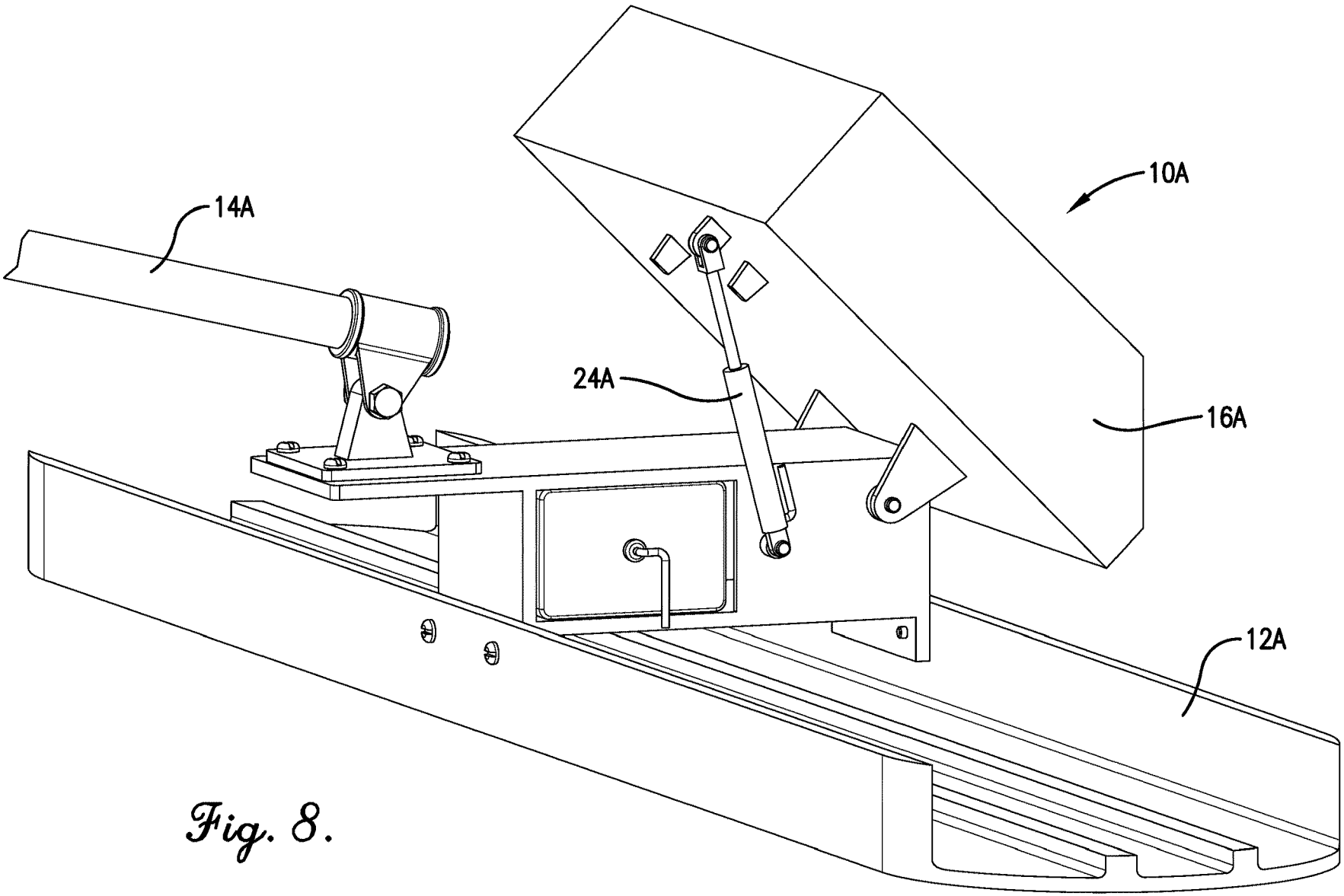
FIG. 8 is a rear perspective view of the concrete forming tool of FIG. 7 with its concrete holding tray in a raised position.
Figure 9:
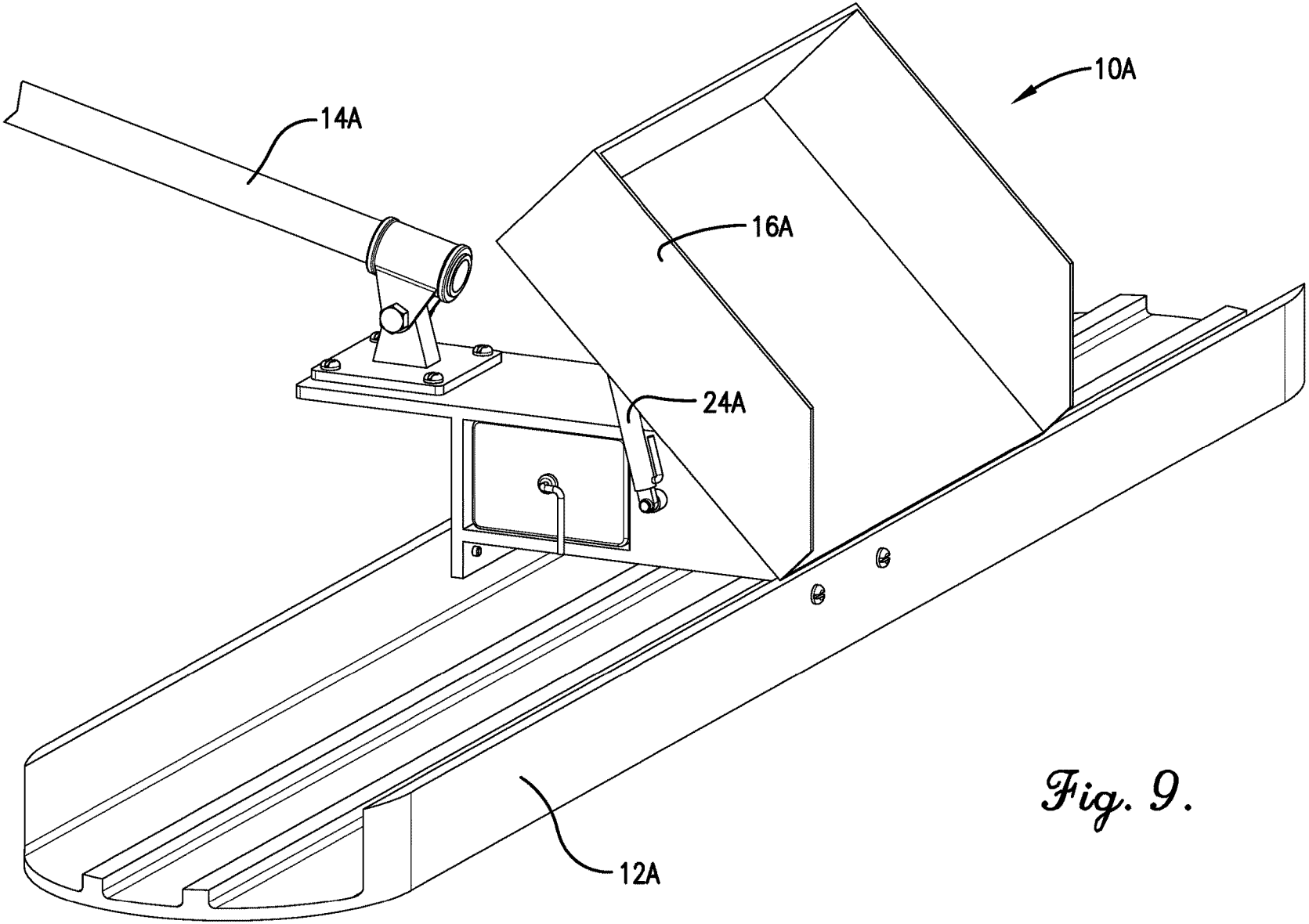
FIG. 9 is a front perspective view of the concrete forming tool of FIG. 7 with its concrete holding tray in a raised position.
Figure 13:
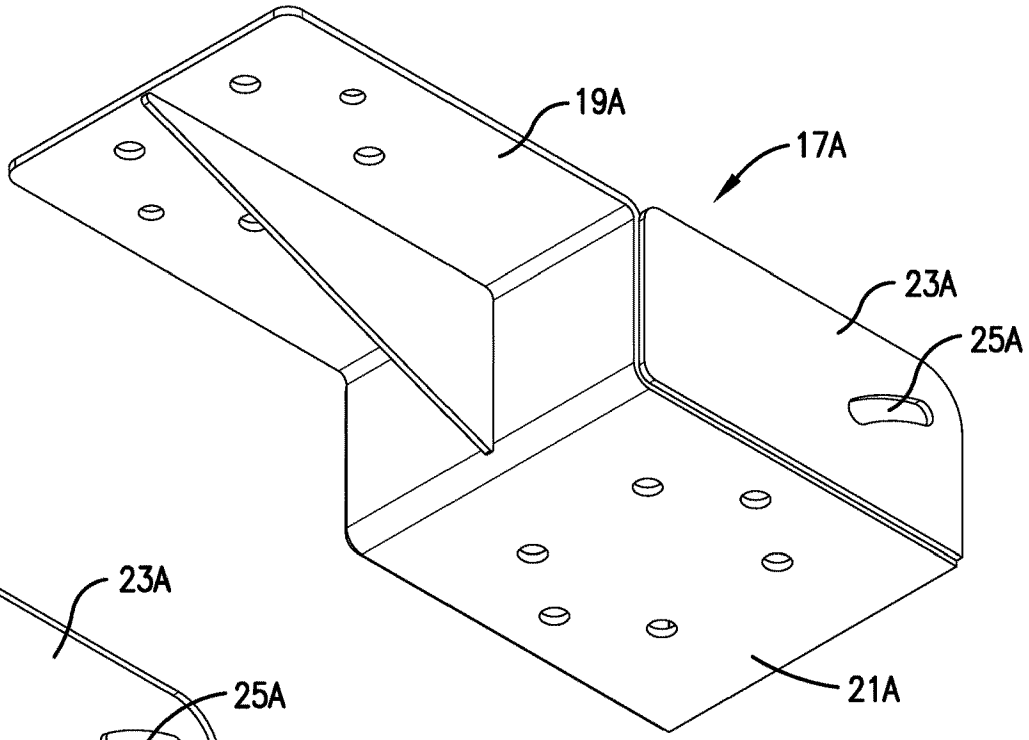
FIG. 13 is a bottom perspective view of the bracket of FIG. 12.
Figure 12:
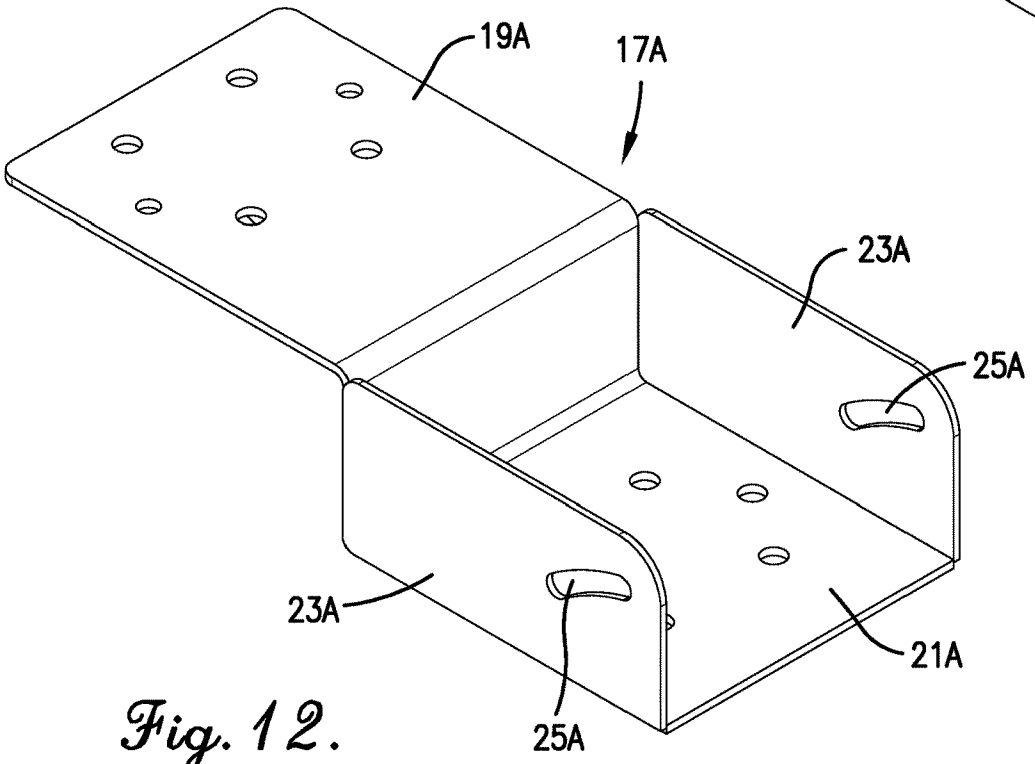
FIG. 12 is a top perspective view of a bracket that may be used in some embodiments of the invention.

In another embodiment depicted in FIGS. 7-9, a concrete forming tool 10A includes only one tray 16A centered on the float 12A and lifted by a cylinder or other actuator 24A. In this embodiment, the tray 16A is hinged to dump wet cement in front of the float. FIGS. 12 and 13 depict a bracket 17A that may be used to mount the tray 16A to the float 12A. The bracket 17A includes an attachment plate 19A to which the pole 14A many be bolted or otherwise secured and a mounting plate 21A that may be bolted or otherwise secured to the float 12A. The mounting plate 21A includes two sidewalls 23A, each with a curved slot 25A which may receive and guide a bolt or other follower attached to the tray 16A to guide the tray between its raised and lowered positions.

The forming tool 10 may also include one or more vibration motors or elements 32 attached to the float and/or to the trays to help urge the wet cement from the trays onto the slab. These vibration elements may also be controlled by switches 34 on the handle and/or the remote control 30. In other embodiments, the vibration elements may turn on automatically when the trays are raised. In some embodiments, the switches 34 on the handle and/or the remote control 30 can adjust the vibrational forces of the vibration elements so that a mason can select the proper amount of vibrational force needed to deposit a desired amount of cement onto the slab.

In use, a mason fills the trays 16, 18 or the single tray 16A with wet cement or other Tillable materials and then manipulates the float 12 or 12A over a slab of concrete to smooth the upper surface of the slab. When a void or other imperfection is detected, the mason may operate the cylinders 24, the cylinder 24A, or other actuators to raise the tray or trays to deposit a quantity of cement from the tray or trays onto a desired location on the slab. The mason may also activate the vibration motor 32. The mason may then manipulate the float over the newly deposited cement to integrate it with the other cement in the slab.

A concrete forming tool constructed in accordance with another embodiment of the invention comprises a float with an internal hollow cavity that may be filled with wet concrete or other Tillable materials and a powered plunger, squeegee, or other mechanism that may be operated to push the wet concrete out of the cavity onto a concrete slab to fill voids in the slab. In other embodiments, the trays 16, 18 or the single tray 16A may be replaced with bowls, pans, or any other concrete holder. In some embodiments, the trays and actuators are assembled on the float, and in other embodiments, the trays and actuators are made and sold separately from the float and configured to be installed on a conventional float.

ADDITIONAL CONSIDERATIONS

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the current technology can include a variety of combinations and/or integrations of the embodiments described herein.

Although the present application sets forth a detailed description of numerous different embodiments, the legal scope of the description is defined by the words of the claims set forth at the end of this patent and equivalents. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

The patent claims at the end of this patent application are not intended to be construed under 35 U.S.C. § 112(f) unless traditional means-plus-function language is expressly recited, such as "means for" or "step for" language being explicitly recited in the claim(s).

Although the invention has been described with reference to the embodiments illustrated in the attached drawing figures, it is noted that equivalents may be employed and substitutions made herein without departing from the scope of the invention.

The invention claimed is:

1. A concrete forming tool for finishing a concrete slab, the concrete forming tool comprising:

a float;

a concrete holder positioned on the float for holding wet concrete, the concrete holder being pivotally connected to the float and moveable relative to the float to a raised position in which at least some of the wet concrete is discharged from the concrete holder; and an actuator for moving the concrete holder relative to the float to the raised position for discharging wet concrete from the concrete holder onto the concrete slab as it is being finished with the forming tool.

2. The concrete forming tool as set forth in claim 1, wherein the concrete holder is a tray positioned on top of the float.

3. The concrete forming tool as set forth in claim 2, wherein the actuator is an electrically operated cylinder for raising the tray to the raised position to dump the wet concrete onto the concrete slab.

4. The concrete forming tool as set forth in claim 2, further comprising a mechanical vibrator for vibrating the tray to urge the wet concrete off the tray.

5. The concrete forming tool as set forth in claim 4, wherein the vibrator and the actuator may be operated in unison.

6. The concrete forming tool as set forth in claim 4, wherein the vibrator and the actuator may be operated independently.

7. The concrete forming tool as set forth in claim 1, further comprising an actuator switch for turning the actuator on and off.

8. The concrete forming tool as set forth in claim 2, further comprising a handle attached to the float.

9. The concrete forming tool as set forth in claim 7, further comprising a remote control that sends wireless signals to the actuator switch.

10. The concrete forming tool as set forth in claim 4, further comprising a vibrator switch for turning the vibrator on and off.

11. The concrete forming tool as set forth in claim 10, further comprising a handle attached to the float, wherein the vibrator switch is located on the handle.

12. The concrete forming tool as set forth in claim 10, further comprising a remote control that sends wireless signals to the vibrator switch.

13. A concrete forming tool for finishing a concrete slab, the concrete forming tool comprising:

a float for smoothing the concrete slab;

a handle attached to the float so that a user may manually move the float over the concrete slab;

a tray positioned on top of the float for holding wet concrete, the tray being pivotally connected to the float and moveable relative to the float between a lowered position in which it retains the wet concrete and a raised position in which it discharges at least some of the wet concrete;

an electrically operated cylinder for raising the tray to the raised position to dump the wet concrete onto the concrete slab as it is being finished with the forming tool; and a mechanical vibrator for vibrating the tray to urge the wet concrete off the tray.

14. The concrete forming tool as set forth in claim 13, wherein the vibrator and the cylinder may be operated in unison.

15. The concrete forming tool as set forth in claim 13, wherein the vibrator and the cylinder may be operated independently.

16. The concrete forming tool as set forth in claim 13, further comprising an actuator switch for raising and lowering the cylinder.

17. The concrete forming tool as set forth in claim 16, wherein the actuator switch is located on the handle.

18. The concrete forming tool as set forth in claim 16, further comprising a remote control that sends wireless signals to the actuator switch.

19. The concrete forming tool as set forth in claim 13, further comprising a vibrator switch for turning the vibrator on and off.

20. A concrete forming tool for finishing a concrete slab, the concrete forming tool comprising:

a float for smoothing the concrete slab;

a handle attached to the float so that a user may manually move the float over the concrete slab;

two trays positioned on top of the float for holding wet concrete;

an electrically operated cylinder for raising the trays relative to the float to dump the wet concrete onto the concrete slab as it is being finished with the forming tool, the cylinder operable to raise the two trays in unison or independently of one another;

a mechanical vibrator for vibrating the trays to urge the wet concrete off the tray; and switches for activating the cylinder and the vibrator.

* * * * *